US010274893B2

(12) United States Patent
Yasui et al.

(10) Patent No.: US 10,274,893 B2
(45) Date of Patent: Apr. 30, 2019

(54) STRUCTURE OF IMAGE FORMING APPARATUS

(71) Applicant: CANON KABUSHIKI KAISHA, Tokyo (JP)

(72) Inventors: Ryota Yasui, Tokyo (JP); Hiromasa Katayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/493,504

(22) Filed: Apr. 21, 2017

(65) Prior Publication Data

US 2017/0219992 A1 Aug. 3, 2017

Related U.S. Application Data

(63) Continuation of application No. PCT/JP2015/081800, filed on Nov. 5, 2015.

(30) Foreign Application Priority Data

Nov. 5, 2014 (JP) ..... 2014-224999

(51) Int. Cl.
*G03G 21/16* (2006.01)
*B41J 29/02* (2006.01)
*B41J 29/13* (2006.01)

(52) U.S. Cl.
CPC ..... *G03G 21/1619* (2013.01); *B41J 29/02* (2013.01); *B41J 29/13* (2013.01); *G03G 2215/0132* (2013.01); *G03G 2221/1678* (2013.01)

(58) Field of Classification Search
CPC ..... G03G 21/1619; G03G 2221/1678
See application file for complete search history.

(56) References Cited

U.S. PATENT DOCUMENTS 6,678,487 B2 1/2004 Tashiro et al.
7,460,142 B2 * 12/2008 Masaki ..... G03G 15/04 347/138
2009/0274484 A1 * 11/2009 Takemoto ..... G03G 21/16 399/107
2013/0099638 A1 4/2013 Pala
(Continued)

FOREIGN PATENT DOCUMENTS

EP 2 138 907 A2 12/2009
JP H08-229523 A 9/1996
(Continued)

OTHER PUBLICATIONS

PCT International Search Report and Written Opinion dated Jan. 26, 2016, in PCT/JP2015/081800.
(Continued)

*Primary Examiner* — Rodney A Bonnette
(74) *Attorney, Agent, or Firm* — Venable LLP

(57) ABSTRACT

A frame of an image forming apparatus includes a bottom plate provided at a bottom of the frame, a plurality of recessed portions each provided on the bottom plate so as to extend toward an inside of the bottom plate, the recessed portions crossing each other, and a reinforcing member fastened to the bottom plate so as to cover at least a portion where the recessed portions cross each other, an area of the reinforcing member being smaller than an area of the bottom plate.

32 Claims, 10 Drawing Sheets

(56) References Cited

U.S. PATENT DOCUMENTS

| | | | | |
|---|---|---|---|---|
| 2013/0195503 | A1* | 8/2013 | Nakagaki | A47B 91/02 399/107 |
| 2014/0001696 | A1 | 1/2014 | Yoshida | |
| 2014/0160713 | A1* | 6/2014 | Eguchi | H05K 7/1488 361/807 |
| 2015/0063864 | A1* | 3/2015 | Kitan | G03G 21/1619 399/107 |

FOREIGN PATENT DOCUMENTS

| | | | |
|---|---|---|---|
| JP | H09-050158 | A | 2/1997 |
| JP | H11-125943 | A | 5/1999 |
| JP | 2002-016384 | A | 1/2002 |
| JP | 2002-023442 | A | 1/2002 |
| JP | 3304149 | B2 | 7/2002 |
| JP | 2002-217560 | A | 8/2002 |
| JP | 2005-221905 | A | 8/2005 |
| JP | 2006-142736 | A | 6/2006 |
| JP | 5508673 | B2 | 6/2014 |

OTHER PUBLICATIONS

Notice of Allowance dated Apr. 30, 2018, issued in Korean Patent Application No. 10-2017-7014324.
Extended European Search Report dated May 18, 2018 issued in European Patent Application No. 15857259.4.

* cited by examiner

STRUCTURE OF IMAGE FORMING APPARATUS

This application is a continuation of PCT Application No. PCT/JP2015/081800, filed on Nov. 5, 2015, which is a continuation of Japanese Patent Application No. 2014-224999, filed on Nov. 11, 2014, both of which are incorporated by reference.

TECHNICAL FIELD

The present invention relates to a structure of an image forming apparatus such as a printer, a facsimile machine, a copying machine or a multi-function machine having a plurality of functions of these machines, for example.

BACKGROUND ART

The image forming apparatus is provided on an installing surface for the apparatus, such as a floor, at, e.g., four places by a member such as casters. However, in the case where flatness of the installing surface is not good, even when installing portions are thus provided at four places, the image forming apparatus is stable in a plane formed by three points. In this case and when the rigidity of the structure of the image forming apparatus, constituted by a frame or the like, is insufficient, a portion of the structure which is not supported goes down, so that there is a possibility that flexure and twisting are generated in the structure. Further, even in a constitution in which the image forming apparatus is installed on the installing surface at three places, the load acting on respective points contacting the installing surface varies depending on the flatness of the installing surface, so that there is the possibility that flexure and twisting are generated in the structure. When the flexure and the twisting thus generate in the structure, accuracy of respective portions for carrying out image formation lowers, so that there is a possibility that the lowering in accuracy has an influence on an image quality.

Therefore, a constitution in which rigidity of a bottom of a structure in which an installing portion for installing the apparatus on an installing surface is formed has been conventionally proposed. For example, one in which the bottom is not constituted by a single metal plate but is constituted in a box type by combining two or more metal plates has been proposed (Japanese Laid-Open Patent Application (JP-A 2002-217560). Further, also a constitution in which the bottom is formed by connecting a base reinforcing member, prepared by connecting intermediary members in a diagonal line shape, with a base body (JP-A 2005-221905).

SUMMARY OF THE INVENTION

Problems to be Solved by the Invention

However, in the case of JP-A 2002-217560 and JP-A 2005-221905 as described above, there are problems as described below. That is, in the case where the bottom is formed by superposing the two metal plates in the box shape as in the constitution of JP-A 2002-217560, not only a weight of the structure increases but also a material cost increases.

Further, in the case of the constitution of JP-A 2005-221905, there is a need to not only connect the intermediary members in the diagonal line shape but also further connect the thus formed base reinforcing member with the base body. Therefore not only does the number of processing steps increase, but also the number of parts and the material cost increases. Accordingly, in either case of the constitutions, the increase in manufacturing cost cannot be avoided. Further, in the case of JP-A 2005- 221905, it would be considered that rigidity becomes lower than that of the constitution of the box shape disclosed in JP-A 2002-217560.

Incidentally, in the image forming apparatus, the image forming apparatus is grounded movably by casters in many cases, and it is desired that not only the rigidity of the bottom of the structure but also the rigidity of the installing portion to which the casters are mounted are enhanced.

The present invention is achieved, in view of such circumstances, for realizing a constitution capable of enhancing the rigidity of the bottom of the structure or the installing portion with a low cost.

Means for Solving the Problems

According to an aspect of the present invention, there is provided a frame of an image forming apparatus, comprising: a bottom plate provided at a bottom of the frame; first to third installing portions, provided at least three places of the bottom plate, for installing the image forming apparatus; a first recessed portion, where the first installing portion is provided, extended from the first installing portion toward an inside of the bottom plate in a planar direction of the bottom plate; a second recessed portion, where the second installing portion is provided, extended from the second installing portion toward the inside of the bottom plate in the planar direction of the bottom plate and connecting with the first recessed portion; a third recessed portion, where the third installing portion is provided, extended from the third installing portion toward the inside of the bottom plate in the planar direction of the bottom plate and connecting with the first recessed portion and the second recessed portion; and a reinforcing member, provided in a region where the first recessed portion, the second recessed portion and the third recessed portion connecting with each other, for reinforcing the bottom plate by being fastened at bottom plate portions sandwiched between respective recessed portions, the reinforcing member being smaller in area than the bottom plate.

According to a further another aspect of the present invention, there is provided a frame of an image forming apparatus, comprising: a first recessed portion provided on a bottom plate along a diagonal line of the bottom plate; a second recessed portion provided on the bottom plate along another diagonal line of the bottom plate so as to cross the first recessed portion; installing portions, provided at the first recessed portion or the second recessed portion of at least in three corners of the bottom plate, for installing the image forming apparatus; and a reinforcing member, provided in a region where the first recessed portion and the second recessed portion cross each other, for reinforcing the bottom plate by being fastened at bottom plate portions sandwiched between the first recessed portion and the second recessed portion, the reinforcing member being smaller in area than the bottom plate.

According to a further aspect of the present invention, there is provided a frame of an image forming apparatus, comprising: a bottom plate provided at a bottom of the frame; first to third installing portions, provided at least three places of the bottom plate, for installing the image forming apparatus; a first recessed portion extended from the first installing portion toward an inside of the bottom plate in a planar direction of the bottom plate; a second recessed portion extended from the second installing portion toward the inside of the bottom plate in the planar direction of the bottom plate and connecting with the first recessed portion; a third recessed portion extended from the third installing portion toward the inside of the bottom plate in the planar direction of the bottom plate and connecting with the first recessed portion and the second recessed portion; and a reinforcing member, provided in a region where the first recessed portion, the second recessed portion and the third recessed portion connecting with each other, for reinforcing the bottom plate by being fastened at respective bottom plate portions sandwiched between respective recessed portions, the reinforcing member being smaller in area than the bottom plate.

According to a further aspect of the present invention, there is provided a frame of an image forming apparatus, comprising: a first recessed portion provided on a bottom plate along a diagonal line of the bottom plate; a second recessed portion provided on the bottom plate along another diagonal line of the bottom plate so as to cross the first recessed portion; installing portions, provided in neighborhoods of least three corners of the bottom plate, for installing the image forming apparatus; and a reinforcing member, provided in a region where the first recessed portion and the second recessed portion cross each other, for reinforcing the bottom plate by being fastened at bottom plate portions sandwiched between the first recessed portion and the second recessed portion, the reinforcing member being smaller in area than the bottom plate.

Effect of the Invention

According to the present invention, a plate-like member is plastically deformed to form a recessed-shape portion or a installing portion, and therefore it is possible to enhance the rigidity of the bottom of the structure or the installing portion with a low cost.

EMBODIMENTS FOR CARRYING OUT THE INVENTION

<First Embodiment>

Figure 1:
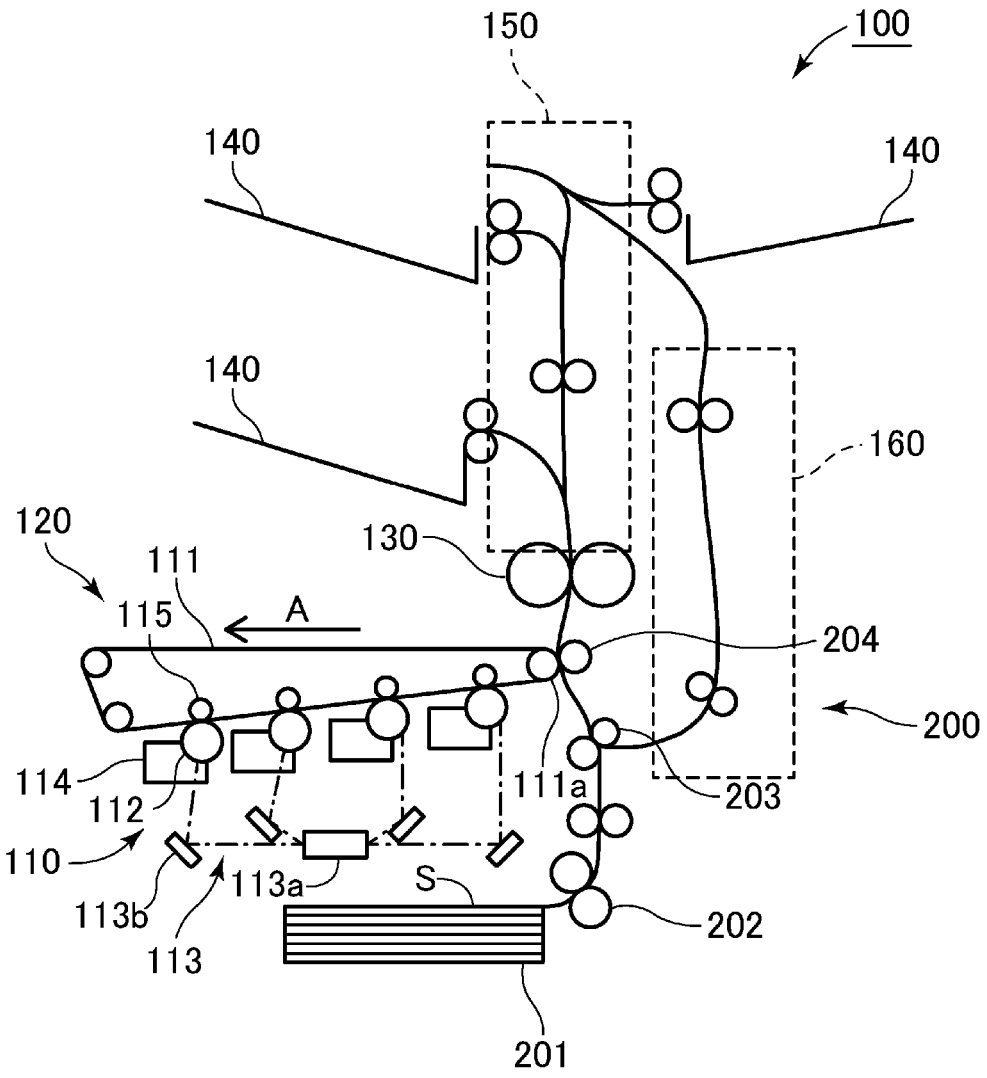
FIG. 1 is a schematic structural view of an image forming apparatus according to a First Embodiment of the present invention.

The First Embodiment of the present invention will be described using FIGS. 1 to 9. First, a schematic structure of an image forming apparatus 100 of this embodiment will be described using FIG. 1.

The image forming apparatus 100 of this embodiment is a full color printer employing an electrophotographic type. Such an image forming apparatus 100 includes an image forming portion 110, a recording material feeding portion 200 and a structure (see FIG. 2). The image forming portion 110 has a constitution of a so-called tandem type in which a plurality of image forming stations are arranged in a traveling (movement) direction of an intermediary transfer belt 11. At the respective image forming stations, toner images of yellow (Y), magenta (M), cyan (C) and black (K) are formed, respectively. The recording material feeding portion 200 feeds a recording material (a sheet material or the like such as a sheet or an OHP sheet) onto which the toner images formed by the image forming portion 110 are transferred. Inside the structure 300, an image forming unit 120 constituted by the image forming portion 110 and the recording material feeding portion 200 and the like is provided. The structure 300 will be described in more detail later.

At the respective image forming stations, the toner images are formed in the following manner. Incidentally, constitutions of the respective image forming stations are similar to each other, and therefore, in the following, the image forming portion at a left end portion of FIG. 1 will be described by adding symbols thereto, and symbols and a description of other image forming stations will be omitted.

First, a surface of a photosensitive drum (photosensitive member) 112 as an image bearing member is electrically charged by an unshown charging device, and the charged surface of the photosensitive drum 112 is exposed by an exposure device 113 to light with a laser or the like depending on image information, so that an electrostatic latent image is formed. The exposure device 113 includes a light emitting portion 113*a* for emitting laser light, a mirror 113*b*, an fθ lens and the like. Then, this electrostatic latent image is developed with toner by a developing device 114, so that the toner image is formed on the surface of the photosensitive drum 112. The toner images formed on the surfaces of the photosensitive drums 112 of the respective image forming stations are transferred onto the intermediary transfer belt 111 by applying primary transfer biases with primary transfer devices 115.

Formation of such toner images is subjected to parallel processing by the respective image forming stations for Y, M, C and K. Then, the toner images formed at the respective image forming stations are successively transferred superposedly onto the intermediary transfer belt 111 fed and driven in an arrow A direction in the figure. Image forming processes for the respective colors are carried out at timing when the toner image is superposed on an upstream toner image which has been primary transferred on the intermediary transfer belt 111. As a result, finally, a full color toner image is formed on the intermediary transfer belt 111 and is fed to a secondary transfer portion. The toner image, on the intermediary transfer belt 111, fed to the secondary transfer portion is transferred onto the recording material fed by the recording material feeding portion 200.

The recording material feeding portion 200 is constituted by a plurality of feeding rollers or the like, and picks up the recording material accommodated in a cassette 201 and feeds the recording material to the image forming portion 110. Specifically, the recording material S is accommodated in the form of being stacked on a lift-up device included in the cassette (feeding device) 201, and is fed in synchronism with image formation timing of the image forming portion 110 by feeding rollers 202. Here, a feeding means for feeding the recording material may also employ, other than a type using friction separation by the feeding rollers 202 or the like, a type using separation attraction by air.

The recording material S fed by the feeding rollers 202 is fed to registration rollers 203. Then, the recording material is subjected to oblique movement correction and timing correction by the registration rollers 203, and thereafter is sent the secondary transfer portion. At the secondary transfer portion, the toner image formed on the intermediary transfer belt 111 is transferred onto the recording material while nipping and feeding the recording material by the intermediary transfer belt 111 and an outer secondary transfer roller 204. At a position opposing the outer secondary transfer roller 204 while sandwiching the intermediary transfer belt 111, an inner secondary transfer roller 111*a* is provided. Then, a secondary transfer bias is applied between these respective rollers, so that the toner image on the intermediary transfer belt 111 is transferred onto the recording material fed at the secondary transfer portion.

Incidentally, in an illustrated example, the recording material is fed toward above the apparatus main assembly from the cassette 201 provided at a lower portion of an apparatus main assembly. For this reason, the recording material feeding portion 200 is provided along a substantially up-down (vertical) direction in one side (right-hand side as seen from a front surface of the apparatus) of the apparatus main assembly from the cassette 201 provided at a lower portion of an apparatus main assembly.

The recording material on which the toner image is transferred is heated and pressed by a fixing device 130, so that the toner image is fixed on the recording material. The fixing device 130 exerts a predetermined pressing force by a roller pair and a heating effect by a heat source such as a heater on the toner image, and melt-fix the toner on the recording material S. Incidentally, the fixing device can also employ, other than the roller pair, other constitutions, which have been conventionally known, such as a belt pair and a combination of a roller and a belt.

The recording material S on which the toner image is fixed passes through a post-fixing feeding portion 150 and is discharged onto a discharge tray 140 as it is. In this embodiment, a plurality of discharge trays 140 are provided, and therefore the recording material S is discharged onto either of the discharge trays 140. Or, in the case where double-surface (side) image formation is required, the recording material S is fed to a reverse feeding device 160, and a toner image is formed on a back surface by the process as described above, so that the recording material S is discharged onto either of the discharge trays 140.

Figure 2:
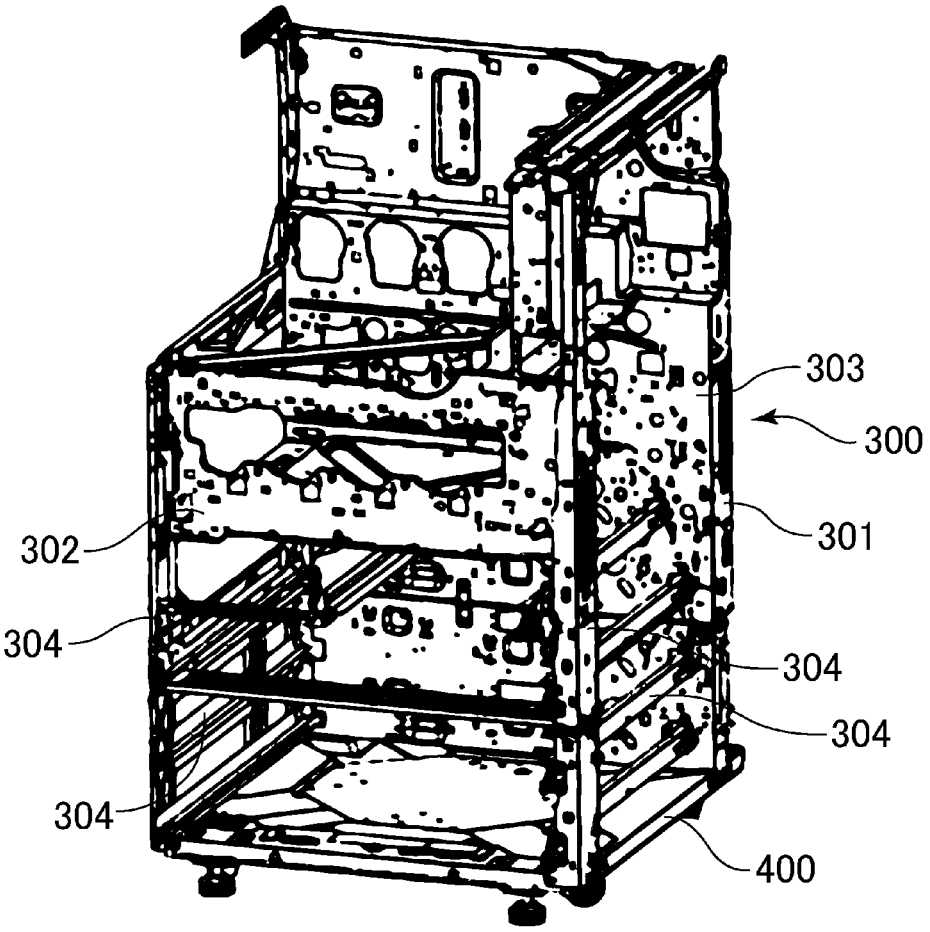
FIG. 2 is a perspective view of a structure of the image forming apparatus according to the First Embodiment.

Further, in the image forming apparatus 100, respective units such as a process cartridge including the developing device and the photosensitive drum can be inserted into and pulled out from the apparatus main assembly by opening an unshown door at the front surface of the apparatus. Accordingly, at a front surface of the structure 300 of the image forming apparatus 100, a large opening and a cut-away portion which are as shown in FIG. 2 are formed in order to carry out exchange of the respective units and insertion and pulling-out of the cassette 201 as described above.

[Structure of Image Forming Apparatus]

Next, such a structure 300 of the image forming apparatus 100 will be described using FIGS. 2 to 8. First, a schematic structure of the structure 300 will be described using FIG. 2. The structure 300 includes a frame 301, in which the image forming unit 120 as described above is provided, and a bottom (portion) 400 for supporting the frame 301. The frame 301 is constituted by a front side plate 302 and a rear side plate 303 which are a pair of frame members provided opposed to each other, and a plurality of various stays 304 and the like. The thus-constituted frame 301 is installed (mounted) on the bottom 400.

[Bottom]

Figure 3:
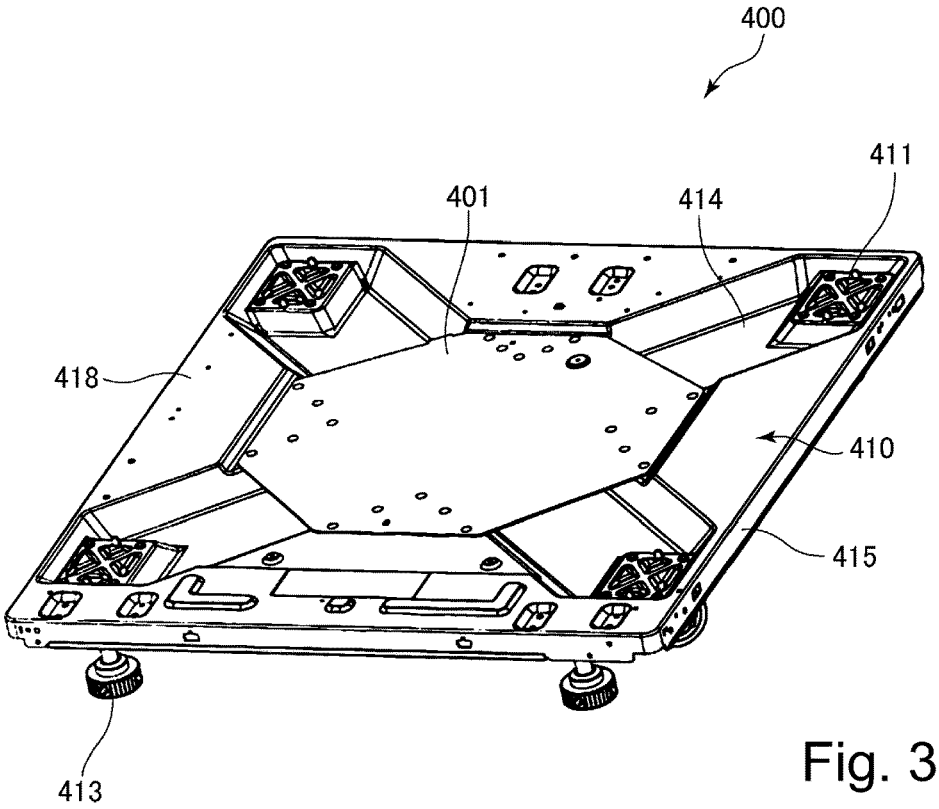
FIG. 3 is a perspective view of a bottom plate portion according to the First Embodiment.
Figure 4:
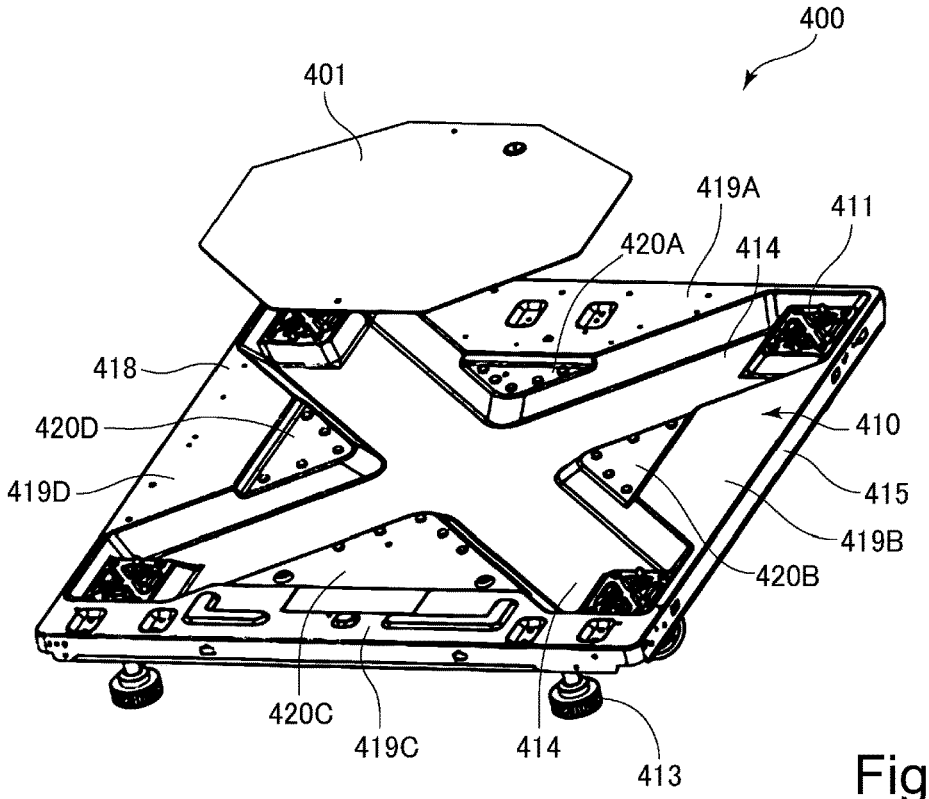
FIG. 4 is an exploded perspective view of a bottom according to the First Embodiment.

Next, the structure of the bottom 400 will be described using FIGS. 3 to 8. The bottom 400 includes, as shown in FIGS. 3 and 4, a bottom plate portion 410 formed from a plate-like member and a reinforcing plate 401 which is a reinforcing member for reinforcing the bottom plate portion. The bottom plate portion 410 and the reinforcing plate 401 are formed as separate members as shown in FIG. 4, and the reinforcing plate 401 is fixed on the bottom plate portion 410 by caulking or the like. Incidentally, the reinforcing plate 401 may also be fixed by bonding or welding, but in the case of this embodiment, the bottom plate portion 410 and the reinforcing plate 401 are formed in a processing line by pressing, such as drawing or blanking (die cutting), and therefore fixing by the caulking is preferable since the plate like member can be processed on this processing line. Further, fixing with screws may also be used, but there is a possibility that deformation of the bottom 400 becomes large due to a deviation of a bottom surface, and therefore caulking or the welding easily ensures rigidity.

Figure 5:
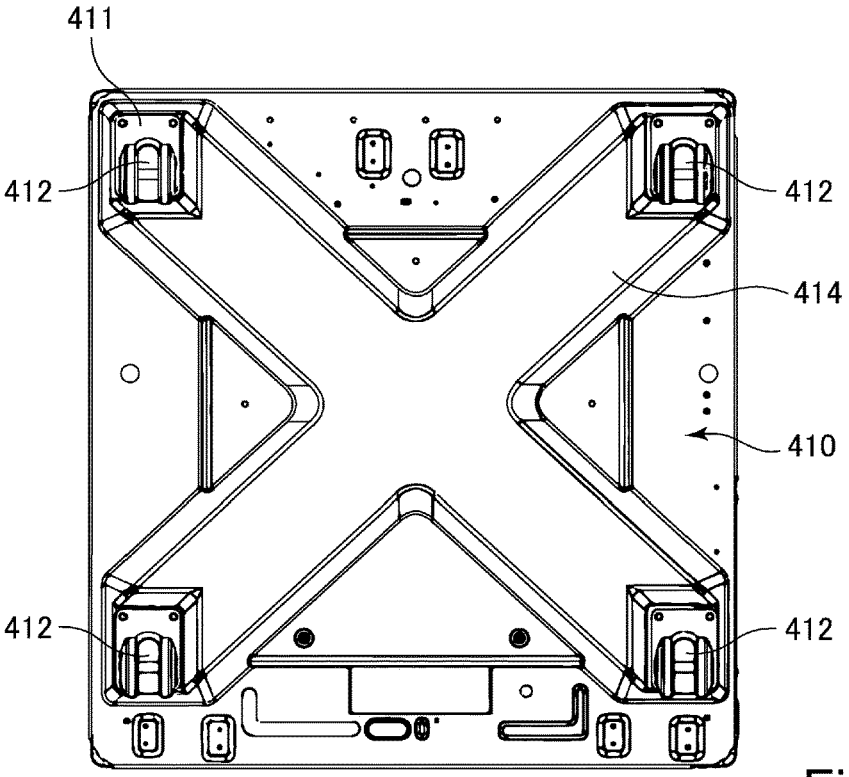
FIG. 5 is a plan view of a state in which casters are mounted on the bottom portion according to the First Embodiment as seen from below.
Figure 6:
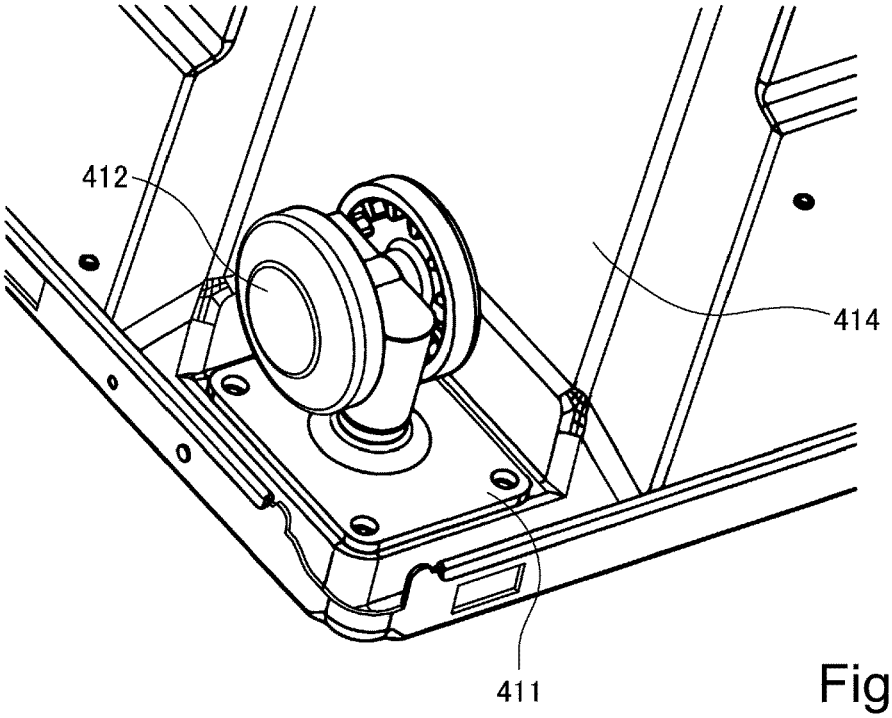
FIG. 6 is a perspective view showing a state in which the caster is mounted on an installing portion according to the First Embodiment.

Further, at a lower surface of the bottom plate portion 410, as shown in FIG. 5, a plurality of installing portions (mounting portions) 411 are formed. In this embodiment, the installing portions 411 are provided in four corners (four places), respectively, of the bottom plate portion 410 formed in a substantially rectangular shape as seen from a lower surface side. At the respective installing portions 411, as shown in FIGS. 5 and 6, casters 412 which are members to be installed on an installing surface, of the apparatus, such as a floor surface are mounted.

Incidentally, the members to be installed may also be, other than the casters 412 for movably supporting the apparatus, members such as legs to be simply mounted on the installing surface. Further, such members may also be formed integrally with the respective installing portions 411. Further, in this embodiment, as shown in FIGS. 3 and 4, non-slip members 413 are provided at the lower surface of the bottom plate portion 410. The non-slip members 413 are used for preventing accidental movement of the apparatus by contacting the apparatus to the floor surface (installing surface) after mounting the apparatus and do not support a load of the apparatus.

[Bottom Plate Portion]

Such a bottom plate portion 410 is formed from a metal plate (plate-like member) such as an electroplated zinc steel plate of 1.2 mm in plate thickness. Specifically, a metal plate die-cut in a predetermined shape and a predetermined size is subjected to drawing by pressing, so that a recessed portion 414 as a recessed-shape portion described below, a bent portion 415 and the above-described installing portions 411 are formed.

The bent portion 415 is formed by bending downward a peripheral edge portion of the bottom plate portion 410. Then, rigidity of the bottom plate portion 410 is enhanced. Incidentally, a bending direction of the bent portion 415 may also be an upward direction.

Figure 7:
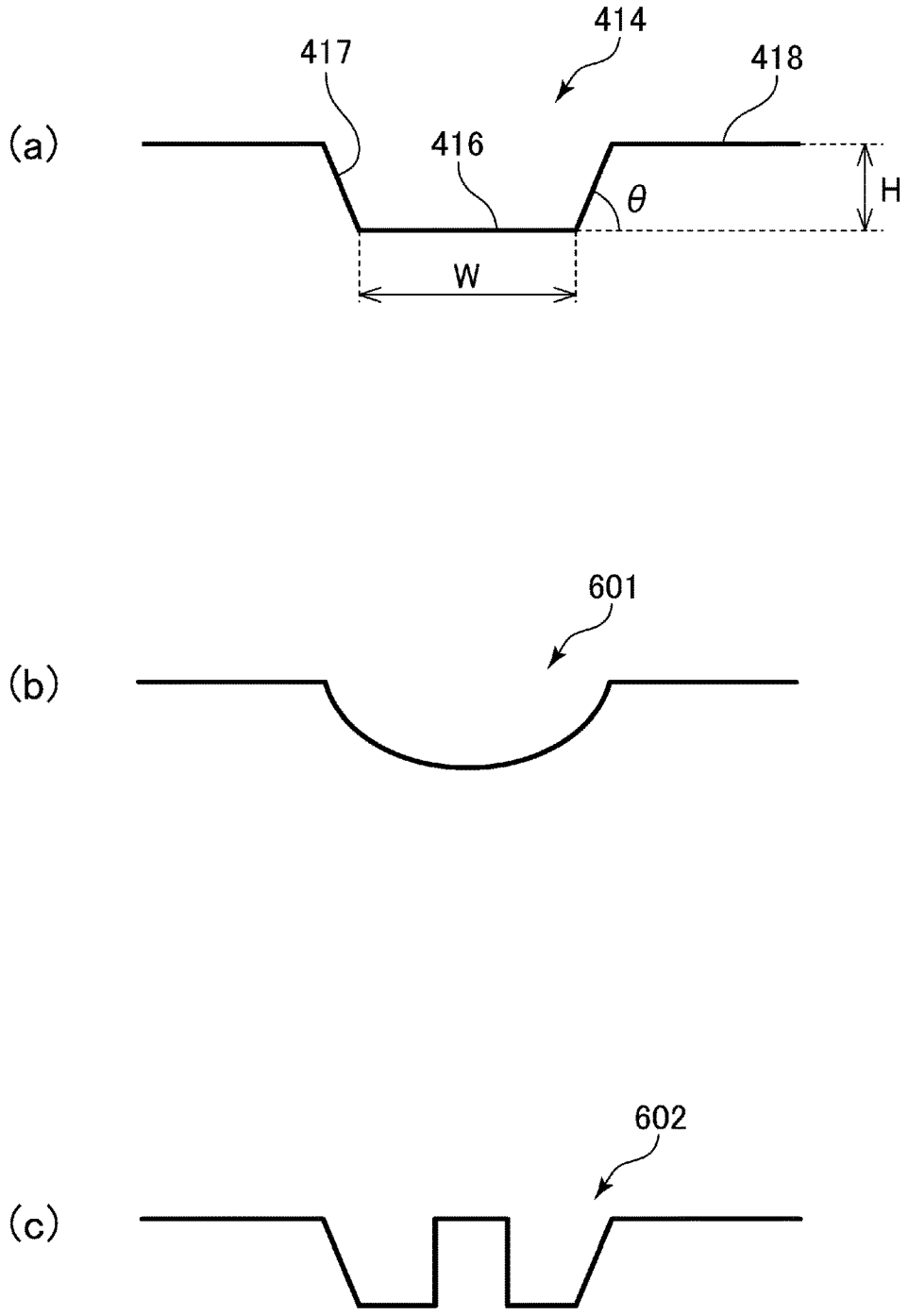
In FIG. 7, (*a*) is an illustration showing a shape of a recessed portion according to the First Embodiment, (*b*) is an illustration showing another first example of the shape of the recessed portion, and (*c*) is an illustration showing another second example of the shape of the recessed portion.

The recessed portion 414 is formed in a shape constituted by a bottom portion 416 and side wall portions 417 at both sides of the bottom portion 416 as shown in (a) of FIG. 7 by plastically deforming the metal plate so that a part of the metal plate is recessed. A direction in which the recessed portion 414 is recessed is the same as the bending direction of the bent portion 415. In this embodiment, the recessed portion 414 is formed by the drawing so as to be recessed downward.

In FIG. 7, (*a*) is a schematic view of the recessed portion cut along a plane perpendicular to a longitudinal direction of the recessed portion 414. The recessed portion 414 is formed with a depth such that the recessed portion 414 does not project from a lower (end) edge of the bent portion 415 and so that the installing portions 411 are accommodated within the a width of the bottom portion 416. Incidentally, a depth of the recessed portion 414 may also be such that the recessed portion 414 projects beyond the lower edge of the bent portion 415 as the rigidity of the bottom plate portion 410 can be enhanced with a larger depth. However, when such a constitution is employed, a dimension of the bottom plate portion 410 with respect to a thickness direction becomes large, so that the apparatus is upsized. Accordingly, the depth of the recessed portion 414 may preferably be set to ensure the rigidity of the bottom plate portion 410 and in consideration of upsizing of the apparatus. In this embodiment, a depth H of the recessed portion 414 was 22.2 mm, for example.

Regarding the width of the bottom portion 416, the width is not necessarily required to be the same along the entirety of the bottom portion 416, and for example, the width may be increased at portions of the installing portions 411 and may be decreased at other portions. Also as regards this width, the width is appropriately set in consideration of rigidity or the like of the bottom plate portion 410. In this embodiment, a width W of the bottom portion 416 was 92.5 mm, for example.

Further, the side wall portions 416 are formed so as to be inclined relative to the bottom portion 416 by an angle θ. That is, a pair of the side wall portions 417 formed in the both sides of the bottom portion 416 is inclined with respect to a direction in which the side wall portions 417 are spaced from each other with an increasing distance from the bottom portion 416. The recessed portion 414 is formed by subjecting the metal plate to pressing, but as described above, the side wall portions 417 are inclined, so that a die can be easily removed during the pressing (process). In this embodiment, the angle θ was 45°. Such side wall portions 417 are formed so as to continuously connect a flat surface portion 418, of the bottom plate portion 410, provided at a periphery of the recessed portion 414 with the bottom portion 416.

Incidentally, the recessed-shape portion formed by the bottom plate portion may also be formed in other shapes such as a recessed portion 601 shown in (b) of FIG. 7, a recessed portion 602 shown in (c) of FIG. 7 and the like, other than the recessed portion 414 shown in (a) of FIG. 7. The recessed portion 601 which is a first example shown in (b) of FIG. 7 is recessed so as to be curved, and the recessed portion 602 which is a second example shown in (c) of FIG. 7 is formed so that a part of the recessed portion projects. Thus, the recessed-shape portion can employ various shapes when the shapes are such that the rigidity of the bottom plate portion 411 can be enhanced by recessing the metal plate.

In the case of this embodiment, the recessed portion 414 as described above is, as shown in FIG. 8, formed so as to connect the plurality of installing portions 411 so that adjacent installing portions cross each other inside a range α enclosed by lines connecting the adjacent installing portions in a shortest distance. Incidentally, the shortest distance between the adjacent installing portions is a distance between centers of the respective installing portions 411.

In this embodiment, the plurality of installing portions 411 are provided at four places (positions) of the bottom plate portion 410. That is, a first installing portion, a second installing, a third installing portion and a fourth installing portion are provided. The recessed portion 414 is formed on diagonal lines of a rectangular shape formed by the installing portions provided at the four places. That is, the recessed portion 414 is formed by causing a first recessed portion 414A and a second recessed portion 414B to cross (connect) with each other. The first recessed portion 414A extends from the first installing portion toward an inside of the bottom plate (toward a center direction of the bottom plate). Further, similarly the second recessed portion 414B extends from the second installing portion 411*b* toward an inside of the bottom plate (toward a center direction of the bottom plate). Incidentally, in this embodiment, the first recessed portion 414A extends on the diagonal line and has a constitution including a third recessed portion 414C positioned in the third installing portion side or a constitution in which the first recessed portion 414A and the third recessed portion 414C are caused to connecting with each other. That is, the first recessed portion 414A and the third recessed portion 414C are disposed in the same rectilinear line shape. Further, similarly, in this embodiment, the second recessed portion 414B extends on another diagonal line and has a constitution including a fourth recessed portion 414D positioned in the fourth installing portion side or a constitution in which the second recessed portion 414B and the fourth recessed portion 414D are caused to connecting with each other. That is, the second recessed portion 414B and the fourth recessed portion 414D are disposed in the same rectilinear line shape. The first recessed portion 414A is formed by connecting the upper-right installing portion 411 and the-lower left installing portion 411 in FIG. 8 by a rectilinear line, and has a shape as shown in (*a*) of FIG. 7. The first recessed portion 414A is formed by connecting the upper-left installing portion 411 and the lower-right installing portion 411 in FIG. 8 by a rectilinear line, and has a shape as shown in (*a*) of FIG. 7. Further, a portion where the first recessed portion 414A and the second recessed portion 414B cross each other is formed so as to be positioned inside the above-described range α.

Figure 8:
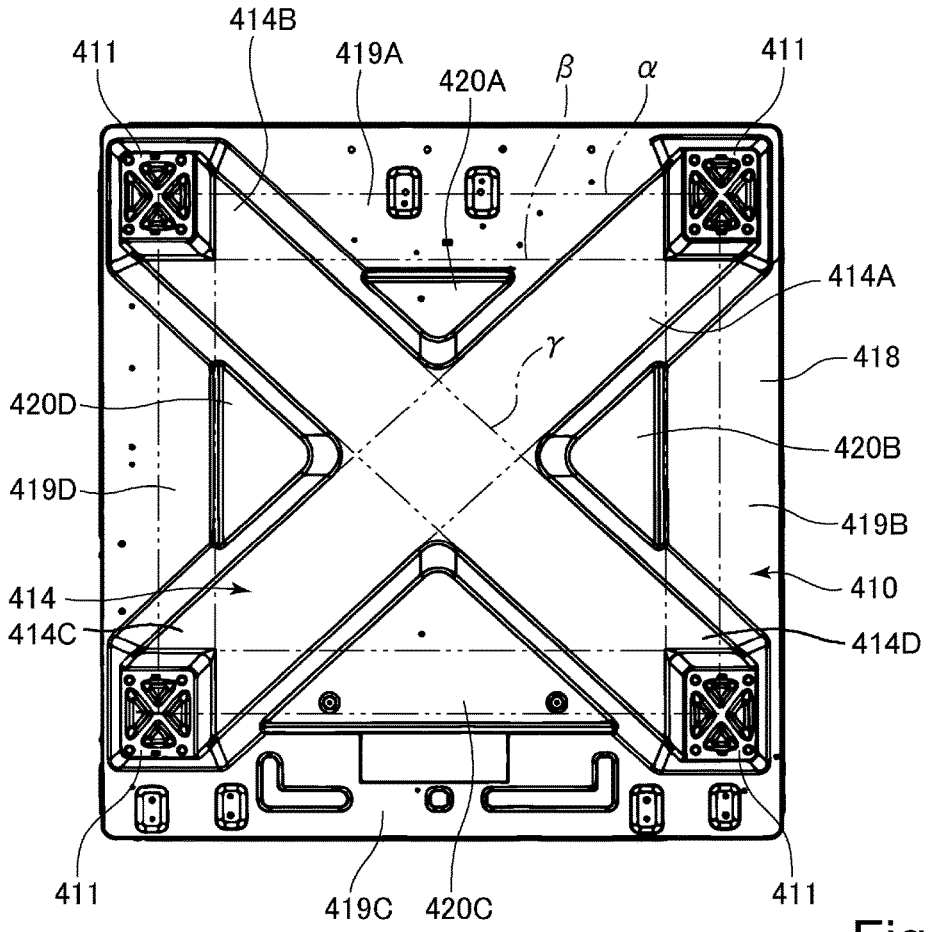
FIG. 8 is a plan view of the bottom according to the First Embodiment.

Incidentally, the portion where the first recessed portion 414A and the second recessed portion 414B cross each other may preferably be formed inside a range of a region β enclosed by lines connecting innermost points (points closest to the bottom plate portion 410) of the respective installing portions 411. Further, it is preferable that a position of the center of gravity of the image forming apparatus 100 falls within a range of a region γ where the first recessed portion 414A and the second recessed portion 414B cross each other. For this reason, in the case where a constitution such that the position of the center of gravity deviates from the region γ shown in FIG. 8 is employed, the region where the first recessed portion 414A and the second recessed portion 414B cross each other may also be deviated from the position shown in FIG. 8. For example, the crossing region is deviated so that the position of the center of gravity of the apparatus falls within the crossing region in such a manner that at least either of the first recessed portion 414A and the second recessed portion 414B is deviated by curving or bending the respective installing portions, not connecting the installing portions by the rectilinear line.

[Reinforcing Plate]

The reinforcing plate 401 is, for example, a metal plate (plate like member) such as an electroplated zinc steel plate of 1.55 mm in plate thickness. In this embodiment, as the reinforcing plate 401, the metal plate formed of the same material as the bottom plate portion 410 is employed, but the material is appropriately selectable. Further, as regards the plate thickness, the reinforcing plate 401 is thicker than the bottom plate portion 410, but also this is appropriately settable. Incidentally, in order to enhance the rigidity of the bottom 400, the plate thickness of the bottom plate portion 410 may preferably be increased. On the other hand, in order to realize a low cost while ensuring the rigidity, it is preferable that the plate thickness of the reinforcing plate 401 which is smaller in area than the bottom plate portion 410 and which is not subjected to the drawing (process) is made larger than the plate thickness of the bottom plate portion 410.

Such a reinforcing plate 401 is, as described above, fixed on the bottom plate portion 410 by caulking or the like. Specifically, the reinforcing plate 401 is fixed on each of a plurality of regions 419A to 419D, of the bottom plate portion 410, so as to connect the plurality of regions 419A, 419B, 419C and 419D divided by the recessed portion 414. That is, the bottom plate portion 410 is divided into the four regions 419A to 419D as shown in FIG. 8 by forming the recessed portion 414 as described above. These four regions 419A to 419D include stepped surfaces 420A, 420B, 420C and 420D formed so that the recessed portion 414 is recessed in the same direction as the recessed portion 414 in a side close to the crossing region γrelative to the flat surface portion 418 in a side remote from the crossing region γ. Further, the bottom plate portion 401 is fixed on each of these stepped surfaces 420A to 420D as fixing portions.

The stepped surfaces 420A to 420D are formed so as to be positioned bottom horizontal surfaces (phantom flat surfaces) passing through an upper end and a lower end of the bent portion 415 of the bottom plate portion 410 and are formed in parallel to the phantom flat surfaces. In other words, the stepped surfaces 420A to 420D are formed within a range of a thickness direction of a substantially rectangular parallelopiped in which a dimension of the bent portion 415 with respect to a bending direction is a thickness dimension. Further, an amount in which the reinforcing plate 410 fixed on the stepped surfaces 420A to 420D projects from the phantom flat surface (the thickness direction of the substantially rectangular parallelopiped) is decreased or eliminated, so that the dimension of the bottom 400 with respect to the thickness direction is made small to the extent possible. In this embodiment, the stepped surfaces 420A and 420D are formed so that the reinforcing plate 401 does not protrude from the phantom flat surface (the thickness direction of the substantially rectangular parallelopiped). In other words, a depth of the stepped surfaces 420A to 420D is made not less than the plate thickness of the reinforcing plate 401.

Further, the reinforcing plate 401 is formed in an octagonal shape in this embodiment so as to be fixed on each of the stepped surfaces 420A to 420D. However, the shape of the reinforcing plate 401 is not limited to such an octagonal shape, but may also be another shape such as a rectangular shape when the reinforcing plate 401 has such a shape that the reinforcing plate 401 can connect the respective stepped surfaces 420A to 420D. However, the reinforcing plate 401 is formed by di-cutting the plate-like member, and therefore may preferably be formed in a shape such that a yield is good. Further, as regards the area of the reinforcing plate 401, the area may preferably be made small to the extent possible within a range in which the rigidity of the bottom 400 can be sufficiently made high since cost reduction is realized, and the area of the reinforcing plate 401 may preferably be made smaller than the above-described range α shown in FIG. 8. Further, more preferably, the area of the reinforcing plate 401 is made smaller than an area occupied by the region β connecting the innermost points of the respective installing portions 411. More specifically, it is preferable that the area of the reinforcing plate 401 is 50% or less per an entire area of the bottom plate portion 410. Further, more preferably, the area of the reinforcing plate 401 is 30% or less per the entire area of the bottom plate portion 410. Further, the reinforcing plate 401 may preferably be provided within the above-described range α. In this embodiment, the reinforcing plate 401 is provided within the range of the above-described region β which is a narrower range than this range α, so that ensuring of the rigidity and the cost reduction are compatibly realized.

[Effect of this Embodiment]

In the case of this embodiment, as described above, the bottom plate portion 410 in which the recessed portion 414 which is the recessed-shape portion is formed by plastically deforming the plate-like member, and the reinforcing plate 401 are fixed, so that the bottom 400 is constituted. For this reason the rigidity of the bottom 400 of the structure 300 can be enhanced at low cost. That is, as in this embodiment, in the case of a constitution in which the image forming apparatus 100 is installed on the installing surface such as the floor surface at the four points, the image forming apparatus 100 is stabilized on the installing surface in a flat surface formed by three points. For this reason, at least any of installing positions of the respective installing portions 411 is different, so that flexure and twisting are liable to be generated in the bottom 400. Therefore, in this embodiment, the installing portions 411 are connected with each other by the recessed portion 414, so that rigidity against the direction of twisting generated due to a difference in installing positions of the installing portions 411 connected by the recessed portion 414 can be enhanced. With this, the reinforcing plate 401 is provided, so that the rigidity against the twisting direction with a line, as a center, of a direction along the recessed portion 414 can be enhanced.

More specifically, deformation generated in the neighborhood of the installing portions 411 due to stress received from the installing surface is suppressed by connecting the respective installing portions 411 with the recessed portion 414. At this time, deformation with, as its center, a line with respect to longitudinal directions (direction along the recessed portion 414) of the first recessed portion 414A and the second recessed portion 414B, which constitute the recessed portion 414, is not readily suppressed when only the recessed portion 414 is formed. For this reason, the reinforcing plate 401 is fixed on the bottom plate portion 410 so as to connect the plurality of regions 419A to 419D divided by the recessed portion 414, so that the deformation with respect to this direction can be efficiently suppressed.

Further, the bottom plate portion 410 is formed by subjecting the plate-like member to the drawing, so that the installing portions 411, the recessed portion 414, the bent portion 415 and the like are formed. Further, the reinforcing plate 401 is formed by di-cutting the plate-like member and has a simple plate shape which is not subjected to the drawing, and the area thereof is sufficiently smaller than the bottom plate portion 410. Specifically, the area occupied by the reinforcing plate 401 is smaller than the area occupied by the range α connecting the respective installing portions 411 and further is smaller than the area occupied by the region β connecting the innermost points of the respective installing portions 411. For this reason, the rigidity of the bottom 400 can be enhanced while reducing a processing cost and a material cost.

[Embodiments]

Next, an experiment conducted for checking such an effect of this embodiment will be described. In the experiment, a constitution using the bottom formed a box shape by combining the two metal plates as described in Patent Document 1 mentioned above (comparison example) and the constitution using the bottom 400 described in this embodiment mentioned above (Embodiment) were compared. Incidentally, also in the comparison example, similarly as in this embodiment, the constitution in which the image forming apparatus was installed at the four points was employed. Specifically, the frame shown in FIG. 2 was combined with each of the bottom in of this Embodiment and the bottom in the comparison example, so that the structure in the Embodiment and the structure in the comparison example were prepared, respectively. Into the respective structures, the image forming unit shown in FIG. 1 mentioned above was incorporated, so that the image forming apparatus in the Embodiment and the image forming apparatus in the comparison example were constituted, respectively. That is, conditions other than the bottom are the same between the Embodiment and the comparison example. Further, in the case where the image forming apparatus was seen from the front surface side (the left side of FIG. 2), a maximum deformation amount of the bottom was compared between the case where the image forming apparatus was installed at the installing portions other than the left front installing portion and the case where the image forming apparatus was installed at the installing portions other than the left-rear installing portion. Further, weights of the bottoms in the Embodiment and the comparison example were compared with each other. This result is shown in FIG. 9.

Figure 9:
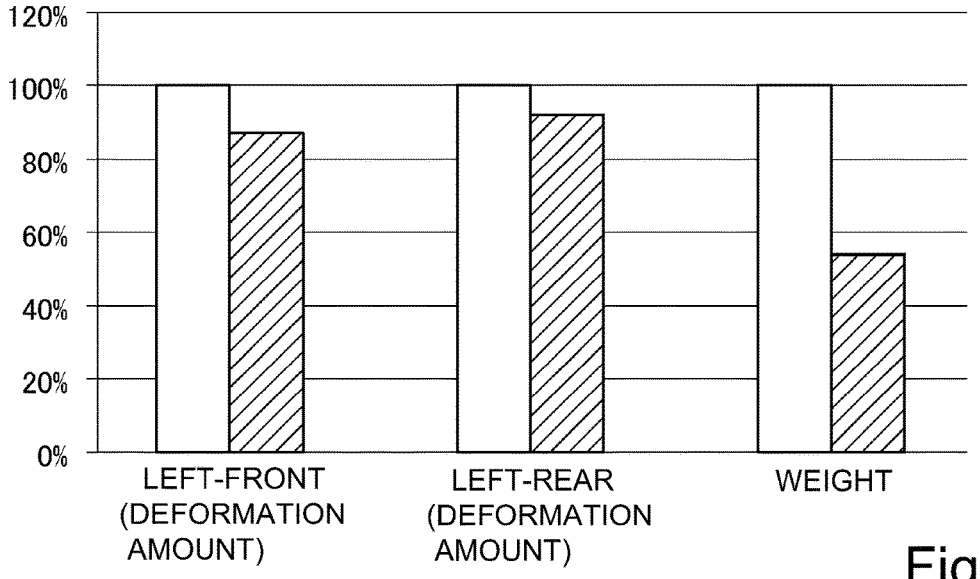
FIG. 9 is an illustration showing an effect of an embodiment employing a structure according to the First Embodiment.

In FIG. 9, a hollow (white) bar graph shows the comparison example, and a hatched bar graph shows the Embodiment. Further, the deformation amounts and the weight in the Embodiment were shown in the case where those in the comparison example are 100%. "LEFT-FRONT" shown at a left-hand end of FIG. 9 is the deformation amount in the case where the image forming apparatus was installed at the installing portions other than the left-front installing portion, and in the Embodiment, the deformation amount was 88% with respect to the comparison example. "LEFT-REAR" shown at a central portion of FIG. 9 is the deformation amount in the case where the image forming apparatus was installed at the installing portions other than the left-rear installing portion, and in the Embodiment, the deformation amount was 93% with respect to the comparison example. "WEIGHT" shown at a right-hand end of FIG. 9 is the weight of the bottom, and in the Embodiment, the weight was 54% with respect to the comparison example. As is apparent from this experiment, in the case of the Embodiment, which is the constitution in this embodiment, it was able to be confirmed that with respect to the comparison example, the deformation amount and the weight of the bottom was able to be made sufficiently small. That is, it was confirmed that the rigidity of the bottom was able to be enhanced with a small number of materials.

Thus, in this embodiment, the deformation with respect to the twisting direction due to the force applied to the installing portions 411 is suppressed by the recessed portion 414 of the bottom plate portion 410. Further, by adding the reinforcing plate 401 having a minimal size for reinforcing the bottom plate portion 410 where the recessed portion 414 is formed, the rigidity with respect to the twisting direction is further improved. By this, the costs including the number of parts, a material cost and a processing cost can be made inexpensive while realizing the rigidity equivalent to or more than the rigidity of the two-plate bottom having the box shape as in the comparison example.

<Second Embodiment>

Figure 10:
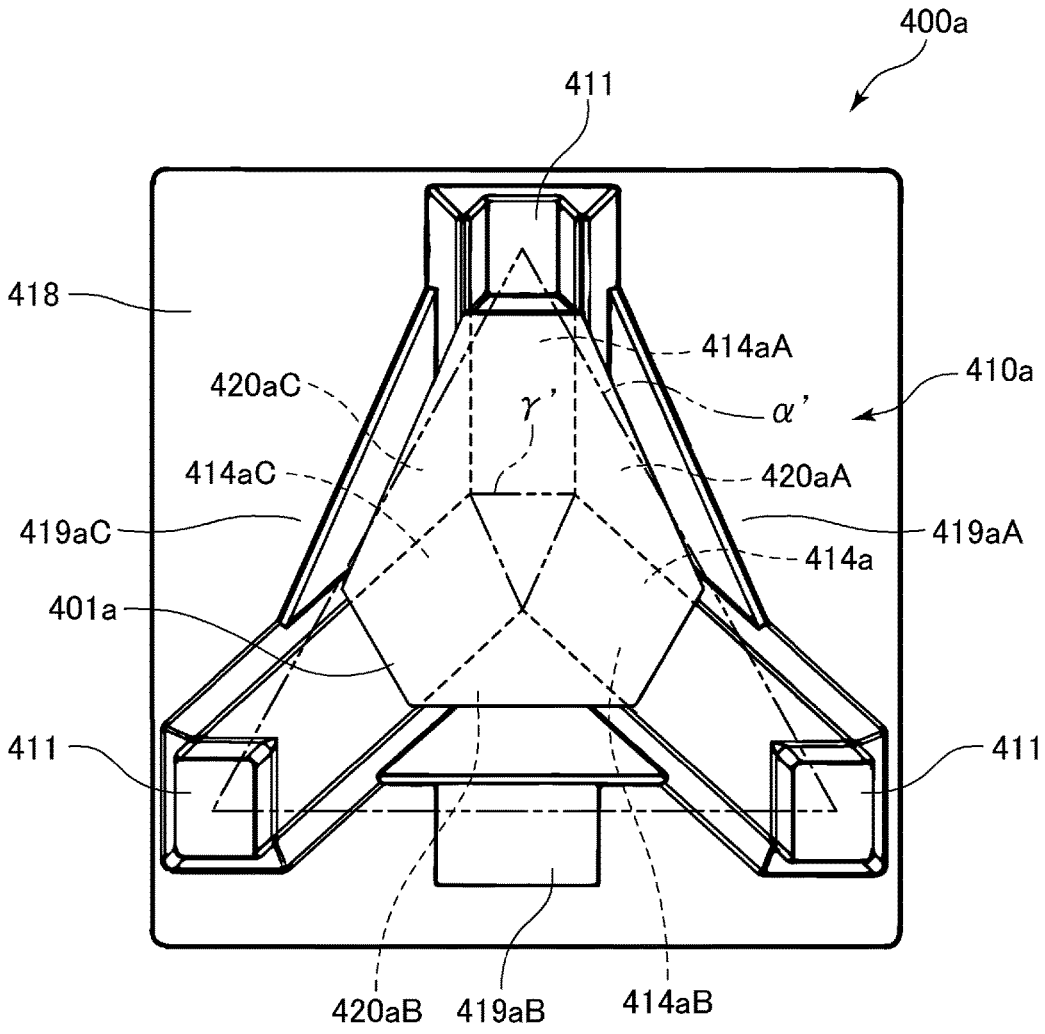
FIG. 10 is a plan view of a bottom according to a Second Embodiment as seen from above.

The Second Embodiment of the present invention will be described using FIG. 10. A bottom 400*a* in this embodiment includes installing portions 411 which are formed on a bottom plate portion 401*a* at three places, and correspondingly, a shape of recessed portion 414*a* which is a recessed-shape portion and a shape of a reinforcing plate 401*a* are made different from those in the above-described First Embodiment. Other constitutions and actions are similar to those in the First Embodiment, and therefore, as regards the constitutions similar to those in the First Embodiment, description and illustration will be omitted or simplified, and in the following, a portion different from the First Embodiment will be principally described.

In the case of this embodiment, the plurality of installing portions 411 are provided at the three places of the bottom plate portion 410*a*. A first installing portion, a second installing portion and a third installing portion are installed. Of the installing portions 411 at the three places, the two directions 411 at the two places are provided in a side where the weight of the image forming apparatus 100 (FIG. 1) becomes large, and the remaining installing portion 411 at the one place is provided in an opposite side. The image forming apparatus 100 in this embodiment is shifted in position of the center of gravity toward the rear (surface) side since heavy objects such as a board, a power source and various motors are provided in the rear side. For this reason, lower-side installing portions 411 at the two places in FIG. 10 and an upper-side installing portion 411 at the one place in FIG. 10 are provided in the rear side and the front side, respectively.

Then, the recessed portion 414*a* having a shape as shown in (a) of FIG. 7 described above is formed so as to connect the plurality of installing portions 411 so that adjacent installing portions cross each other inside a range α' enclosed by lines connecting the adjacent installing portions in shortest distances. Specifically, the recessed portion 414*a* crosses inside a triangular shape formed by the installing portions 411 at the three places. That is, along a line drawn from one installing portion 411 toward an opposite side, each of a first recessed portion 414*a*A, a second recessed portion 414*a*B and a third recessed portion 414*a*C is formed. Then, the first recessed portion 414*a*A, the second recessed portion 414*a*B and the third recessed portion 414*a*C are caused to cross each other inside the above-described range α'. In other words, the recessed portion 414*a* is constituted by a three-pronged (trifurcated) drawing shape extending from an almost center of the triangular shape formed by the installing portions 411 at the three places to the respective installing portions 411.

A crossing position of the recessed portion 411*a* may preferably be a position of the center of gravity of the triangular shape formed by the installing portions 411 at the three places (first condition). Incidentally, in the case of this embodiment, a position of the center of gravity of the image forming apparatus 100 may preferably fall within a range of a region γ' where the first recessed portion 414*a*A, the second recessed portion 414*a*B and the third recessed portion 414*a*C cross each other (second condition). It is preferable that both of the above-described first condition and this second condition are satisfied, but at least one of either of the conditions may preferably be satisfied.

The reinforcing plate 401*a* is fixed on each of a plurality of regions 419*a*A to 419*a*C so as to connect the plurality of regions 419*a*A, 419*a*B and 419*a*C, divided by the recessed portion 414*a*, with each other. That is, the bottom plate portion 410*a* is divided into the three regions 419*a*A to 419*a*C by forming the recessed portion 414*a* as described above. These three regions 419*a*A to 419*a*C include stepped surfaces 420*a*A, 420*a*B and 420*a*C formed so as to be recessed in the same direction as the recessed portion 414*a* in a side close to the region γ' where the recessed portions 414*a* cross each other with respect to a flat surface portion 418 positioned in a side remote from the region γ'. Further, the reinforcing plate 401*a* is fixed on each of these stepped surfaces 420*a*A to 420*a*C as fixing portions.

Further, the reinforcing plate 401*a* is formed in a pentagonal shape in order to be fixed on each of the stepped surfaces 420*a*A to 420*c*C. However, the shape of the reinforcing plate 401*a* is not limited to such a pentagonal shape, but may also be other shapes such as a triangular shape and a trapezoidal shape when the respective stepped surfaces 420*a*A to 420*a*C can be connected with each other. Further, as regards an area of the reinforcing plate 401*a*, it is preferable that the area is made small to the extent possible within a range in which the rigidity of the bottom 400*a* can be sufficiently made high, and the reinforcing plate 401*a* may preferably be provided within the above-described range α' shown in FIG. 10. In this embodiment, a part of the reinforcing plate 401*a* protrudes from the range α', but the reinforcing plate 401*a* may only be required to fall within the range α' in an area of 80% or more, preferably 90% or more, further preferably 95% or more per an area occupied by the reinforcing plate 401*a*. This point is also ditto for First Embodiment.

Also in the case of this embodiment mentioned above, the recessed portions 414*a* and the installing portions 411 are formed by plastically deforming the bottom plate portion 410*a*. With this, the reinforcing plate 401*a* having a simple plate-like shape is fixed so as to connect the plurality of regions 419*a*A to 419*a*C divided by the recessed portions 414*a* of the bottom plate portion 410*a*. By this, the rigidity of the bottom 400*a* can be enhanced with a low cost.

<Third Embodiment>

The Third Embodiment of the present invention will be described using FIGS. 11 to 14. A constitution of a bottom 400*b*in this embodiment is roughly the same as the First Embodiment, but in this embodiment, there is a feature in structure of installing portions 411 and 411*a*, and therefore in the following, this point will be specifically described. Incidentally, as regards other portions similar to those in the First Embodiment, illustration and description will be omitted or simplified.

Figure 11:
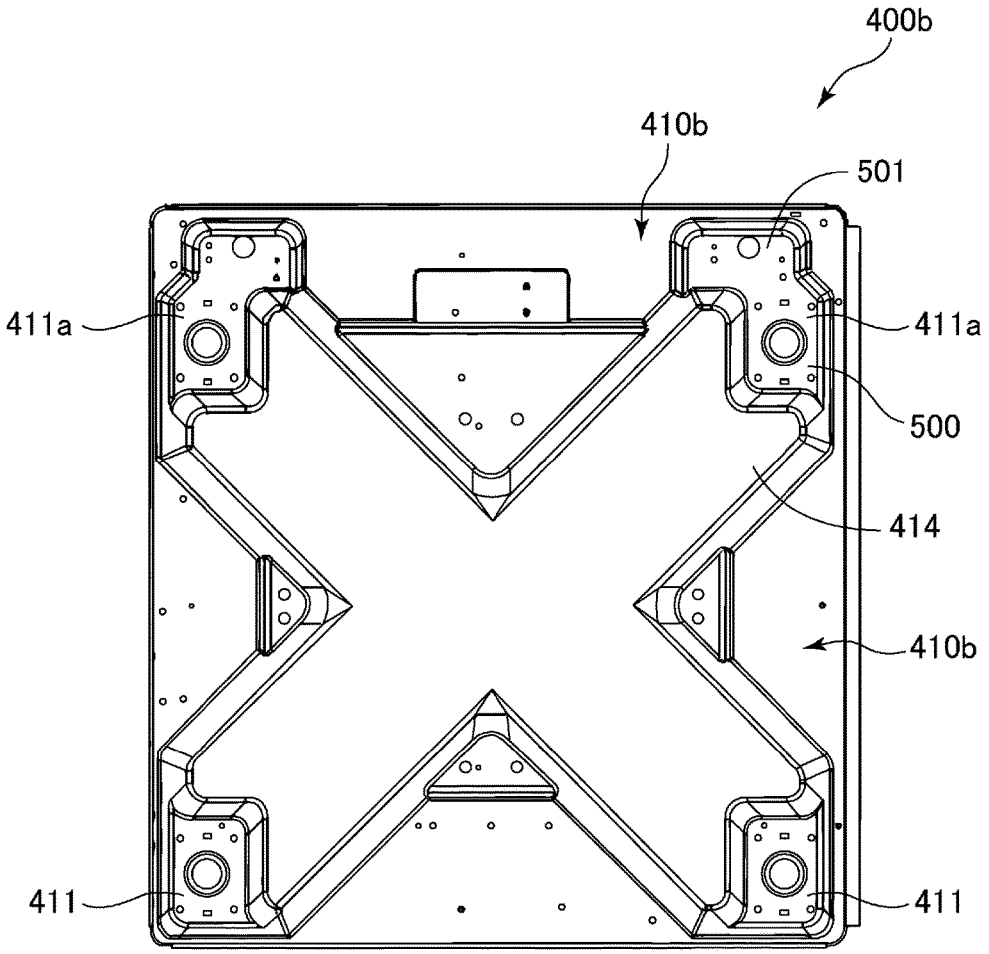
FIG. 11 is a plan view of a bottom plate according to a Third Embodiment as seen from above.
Figure 12:
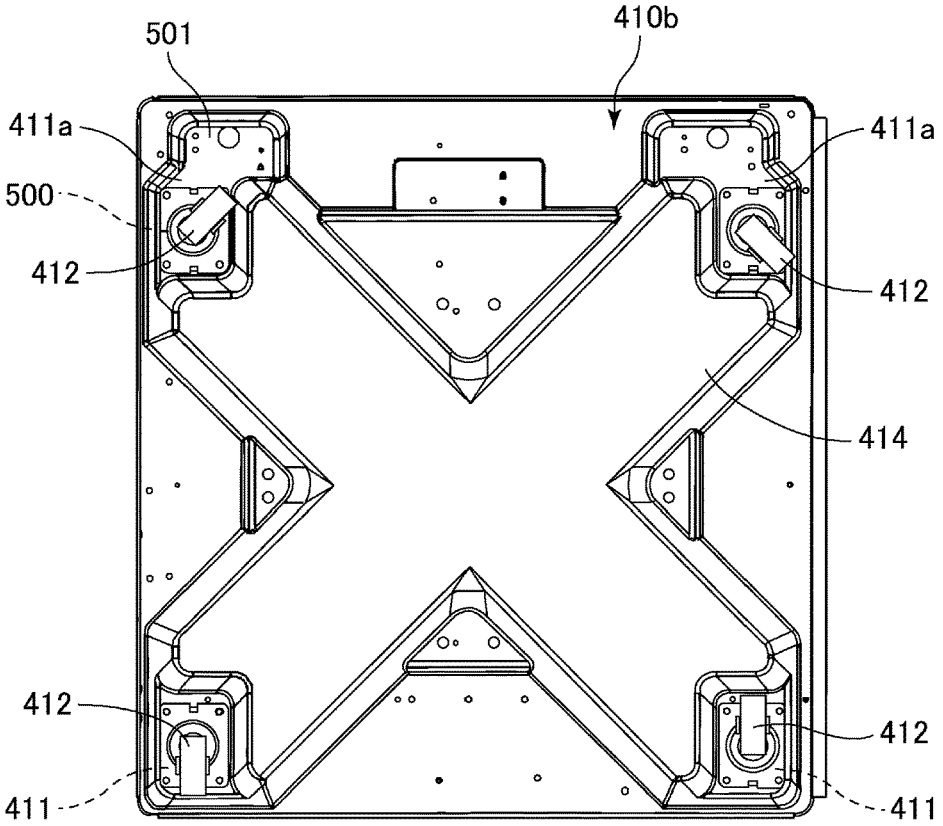
FIG. 12 is a plan view of a state in which casters are mounted on the bottom according to the Third Embodiment.

Also in the case of this embodiment, at a bottom plate portion 410*b* of the bottom 400*b*, installing portions at four places (first installing portion, second installing portion, third installing portion, fourth installing portion are formed. Lower-side installing portions 411 in FIGS. 11 and 12 have the shape similar to that of the installing portions 411 in First Embodiment. On the other hand, upper-side installing portions 411*a*in FIGS. 11 and 12 are formed so that a region 500 where a caster 412 is fixed and a region 501 where a non-slip member 413 (see FIG. 3 or the like) is fixed are continuous to each other. Such installing portions 411*a*to 411*d*are connected by a recessed portion 414 similarly as in First Embodiment. A constitution of portions where casters 412 are fixed at the installing portions are the same, and therefore in the following, the lower-side installing portions 411 in FIG. 11 will be described using FIG. 13.

Figure 13:
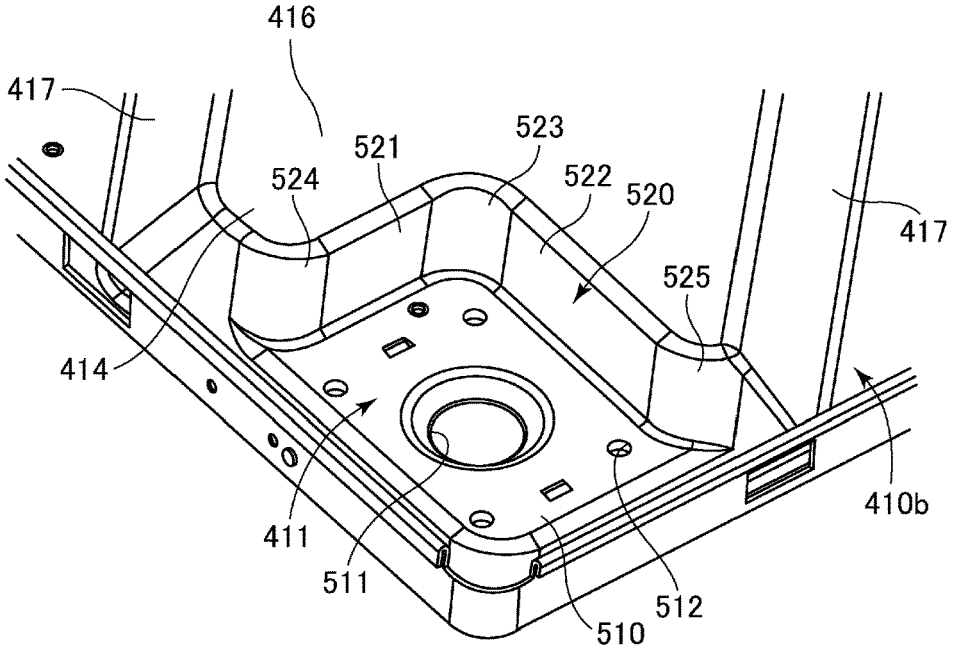
FIG. 13 is a perspective view of an installing portion according to the Third Embodiment as seen from below.

The plurality of installing portions 411 each includes, as shown in FIG. 13, a mounting surface portion 510 and a mounting side wall portion 520 (partitioning portion) which are formed by plastically deforming a metal plate (plate-like member) which is a material of the bottom plate portion 410*b*. The mounting surface portion 510 is formed in a substantially rectangular shape and is positioned in a side opposite from a side where the recessed portion 414 is recessed with respect to the bottom portion 416, and the caster 412 which is a member to be installed on the installing surface of the apparatus is mounted at the mounting surface portion 510. For this purpose, at the mounting surface portion 510, a mounting hole 511 for mounting the caster 412 and a plurality of fixing holes 512 for fastening the caster 412 with screws.

The mounting side wall portion 520 is formed by a flat surface not only where the mounting surface portion 510 and the recessed portion 414 are continuous to each other but also which extends continuously so as to enclose at least two sides of a periphery of the mounting surface portion 510. In this embodiment, the mounting side wall portion 520 is provided to be inclined with an angle of, e.g., 45° with respect to the mounting surface portion 510 so as to enclose the two sides of the periphery of the mounting surface portion 510. One end side of the mounting side wall portion 520 with respect to a provision direction is continuous to the mounting surface portion 510 via a smooth curved portion, and the other end side of the mounting side wall portion 520 is continuous to the bottom portion 416 of the recessed portion 414 via a smooth curved portion.

Figure 14:
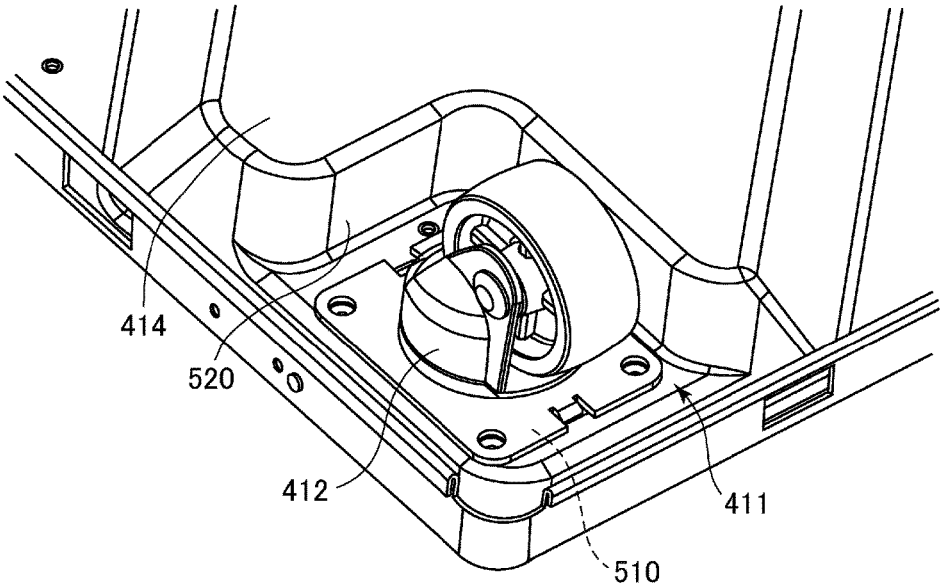
FIG. 14 is a perspective view showing a state in which the caster is mounted on the installing portion according to the Third Embodiment.

Further, the mounting side wall portion 520 includes a first side wall portion 521 and a second side wall portion 522 which are provided so as to be perpendicular to each other, and includes a curved portion 523 smoothly connecting continuously these first side wall portion 521 and second side wall portion 522. These first side wall portion 521 and second side wall portion 522 are provided along a single side of the substantially rectangular mounting surface portion 510. End portions of the first side wall portion 521 and the second side wall portion 522 in sides opposite from the curved portion 523 are continuous to the side wall portions 417 of the recessed portion 414 via smooth curved portions 524 and 525, respectively. At the thus-constituted mounting surface portions 510 of the installing portions 411, as shown in FIG. 14, the casters 412 are mounted.

In the case of this embodiment constituted as described above, the installing portions 411 is formed by plastically deforming a plate-like member, and therefore, the rigidity of the installing portions 411 can be enhanced with a low cost. That is, the installing portions 411 include the mounting side wall portions 520 each formed by the flat surface continuously extending so as to enclose the two sides of the periphery of the substantially rectangular mounting surface portion 510 at which the caster 412 is mounted. For this reason, deformation generating due to stress acting on the installing portions 411 via the casters 412 can be suppressed. Further, the mounting side wall portions 520 are formed so as to be continuous to the respective recessed portions 414 (first recessed portion to fourth recessed portion), and therefore, the deformation can be further suppressed.

Further, the first side wall portion 521 and the second side wall portion 522 of the mounting side wall portion 520 are continuous by the curved portion 523. Further, the mounting side wall portion 510 is continuous to the bottom portion 416 and the side wall portions 417 of the recessed portion 414 via the smooth curved portions, respectively. For this reason, even in the case where the force is applied to the installing portions 411, stress concentration can be alleviated, and also durability can be improved.

<Fourth Embodiment>

Figure 15:
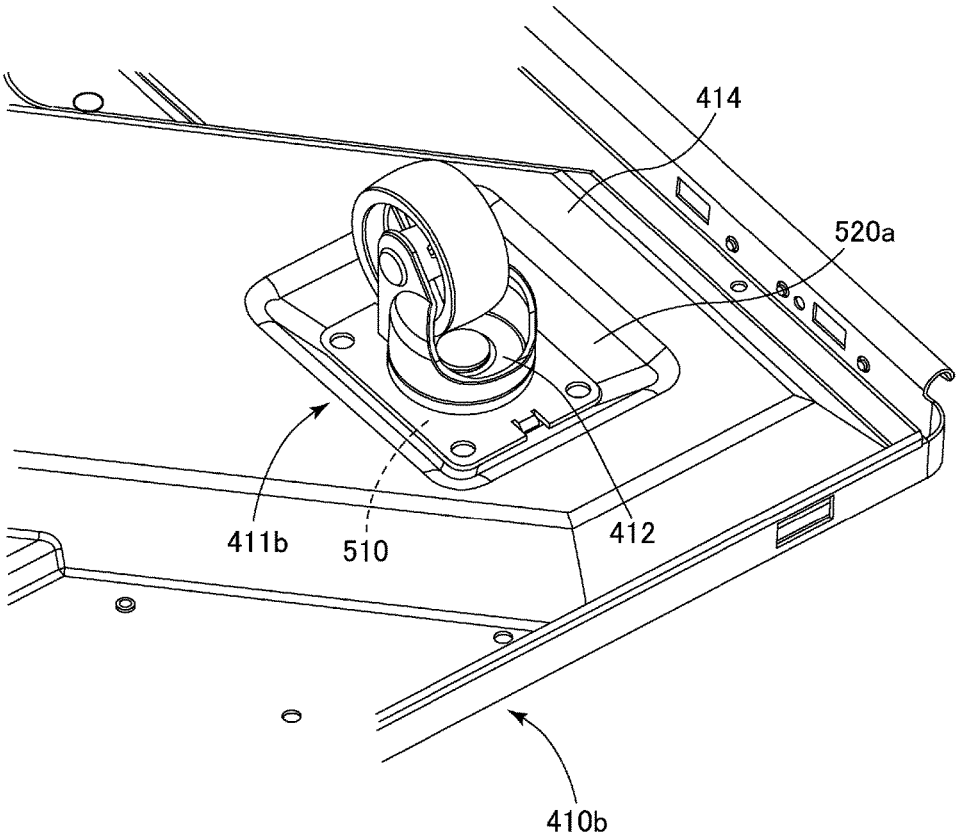
FIG. 15 is a perspective view showing a state in which a caster is mounted on an installing portion according to a Fourth Embodiment.

The Fourth Embodiment of the present invention will be described using FIG. 15. In the case of this embodiment, a mounting side wall portion 520*a* constituting an installing portion 411*b* is formed by a flat surface continuously extending so as to enclose an entirety (four sides) of a periphery of a substantially rectangular mounting surface portion 510. By this, the rigidity of the installing portion 411*b* can be further enhanced. However, the installing portion 411*b* becomes large correspondingly to the enclosure of the entirety of the periphery of the mounting surface portion 510 by the mounting side wall portion 520*a*. Accordingly, a shape of the bottom is larger than that in the case of the above-described Third Embodiment, so that this embodiment is suitable for a constitution in which the weight of the apparatus is large. Other constitutions and actions are similar to those in the above-described Third Embodiment.

<Other embodiments>

The above described Third and Fourth Embodiments are off course applicable to also the constitution in Second Embodiment. The constitutions of the installing portions 411 to described in Third and Fourth Embodiments are applicable to the bottom plate portion including the recessed-shape portion such as the recessed portion, and in this case, are not necessarily be required to be the constitution including the reinforcing plate as in the First and Second Embodiments. Further, in this case, the constitutions are also applicable to a constitution in which the recessed-shape portions formed at the bottom plate portion do not cross each other and a constitution of the installing portions 411.

Further, in the above-described respective embodiments, the recessed-shape portions such as the recessed portions 414 are caused to cross each other within the range $\alpha$, but the recessed-shape portions may also be formed at another portion in addition to this. Further, the reinforcing plate is not limited to the plate-like member, but for example, may also be constituted by a plurality of bar-like members. In this case, the bar-like members are provided so as to connect all of a plurality of regions, of the bottom plate portion, divided by the recessed portion. For example, in the case where the plurality of regions are provided at four places, the region at one place is connected with each of the regions at other three places. Further, the installing portions may only be required to be formed at three places or more, and the installing portions may also be formed at five places or more.

Further, the image forming apparatus to which the present invention is applicable may also have another constitution such as a rotary type in which, e.g., a plurality of developing devices are provided in a cylindrical shape and a toner image is formed on a single photosensitive drum, other than the constitution of the tandem type as shown in FIG. 1. Further, the image forming apparatus to which the present invention is applicable may also be of a direct transfer type in which the toner image is directly transferred onto the recording material, other than the intermediary transfer type using an intermediary transfer member such as the intermediary transfer belt as shown in FIG. 1.

INDUSTRIAL APPLICABILITY

According to the present invention, there is provided a structure of an image forming apparatus capable of enhancing rigidity of the bottom or the installing portions of the structure with a low cost in order to form the recessed-shape portions and the installing portions by plastically deforming the plate-like member.

The invention claimed is:

1. A frame of an image forming apparatus, said frame comprising:

a bottom plate provided at a bottom of said frame;

a first recessed portion provided on said bottom plate and extending from an inside to an outside of said bottom plate in a planar direction of said bottom plate;

a second recessed portion provided on said bottom plate so as to be recessed in the same direction as a recess direction of said first recessed portion and extending from the inside to the outside of said bottom plate in the planar direction of said bottom plate, said second recessed portion connecting with said first recessed portion in the inside in the planar direction;

a third recessed portion provided on said bottom plate so as to be recessed in the same direction as the recess directions of said first recessed portion and said second recessed portion and extending from the inside to the outside of said bottom plate in the planar direction of said bottom plate, said third recessed portion connecting with said first recessed portion and said second recessed portion in the inside in the planar direction; and a reinforcing member configured to reinforce said bottom plate, wherein said reinforcing member is fixed to a first region sandwiched between said first recessed portion and said second recessed portion, a second region sandwiched between said second recessed portion and said third recessed portion, and a third region sandwiched between said third recessed portion and said first recessed portion, so as to cover a connecting region where said first recessed portion, said second recessed portion, and said third recessed portion connect with each other, and wherein an area of said reinforcing member is smaller than an area of said bottom plate.

2. A frame according to claim 1, further comprising first to third installing portions provided in at least three places on said bottom plate and configured to install the image forming apparatus, wherein the area of said reinforcing member is smaller than a region enclosed by said first to third installing portions mounted on said bottom plate.

3. A frame according to claim 2, wherein said first recessed portion, said second recessed portion, and said third recessed portion are formed so as to cross at a position of a center of gravity of a triangular shape formed by said first to third installing portions provided at the three places.

4. A frame according to claim 2, wherein said first installing portion is provided at said first recessed portion, wherein said second installing portion is provided at said second recessed portion, and wherein said third installing portion is provided at said third recessed portion.

5. A frame according to claim 2, wherein each of said first to third installing portions is provided at a position closer to an edge than a central portion of said bottom plate.

6. A frame according to claim 1, wherein the area of said reinforcing member is 50% or less of the area of said bottom plate.

7. A frame according to claim 1, wherein the area of said reinforcing member is 30% or less of the area of said bottom plate.

8. A frame according to claim 1, wherein said reinforcing member is a plate-like member.

9. A frame according to claim 1, wherein said reinforcing member is provided at a surface opposing a frame inner surface side.

10. A frame according to claim 1, wherein the first region, the second region, and the third region include stepped portions formed so as to be more recessed, in the same direction as the recess directions of said first recessed portion, said second recessed portion, and said third recessed portion, on a side close to the connecting region than on a side remote from the connecting region, and wherein said reinforcing member is fixed to said stepped portions.

11. A frame according to claim 10, wherein said reinforcing member is fastened to said stepped portions by caulking.

12. A frame according to claim 1, wherein said bottom plate has a rectangular shape and includes a bent portion at a peripheral edge portion of said bottom plate, said bent portion being bent in a direction in which said first recessed portion, said second recessed portion, and said third recessed portion are recessed relative to a plane of said bottom plate on which said first recessed portion, said second recessed portion, and said third recessed portion are formed.

13. A frame of an image forming apparatus, said frame comprising:

a bottom plate provided at a bottom of said frame;

a first recessed portion provided on said bottom plate along a diagonal line of said bottom plate;

a second recessed portion provided on said bottom plate along another diagonal line of said bottom plate so as to cross said first recessed portion, wherein said second recessed portion is provided so as to be recessed in the same direction as a recess direction of said first recessed portion; and a reinforcing member configured to reinforce said bottom plate, wherein said reinforcing member is fixed to four regions sandwiched between said first recessed portion and said second recessed portion so as to cover a crossing region where said first recessed portion and said second recessed portion cross each other, and wherein an area of said reinforcing member is smaller than an area of said bottom plate.

14. A frame according to claim 13, further comprising a plurality of installing portions configured to install the image forming apparatus, one of the plurality of installing portions being provided in a neighborhood of each of at least three corners of said bottom plate, and wherein the area of said reinforcing member is smaller than a region enclosed by said plurality of installing portions mounted on said bottom plate.

15. A frame according to claim 14, wherein said plurality of installing portions are provided at said first recessed portion and said second recessed portion.

16. A frame according to claim 14, wherein each of said plurality of installing portions is provided at a position closer to an edge than a central portion of said bottom plate.

17. A frame according to claim 13, wherein the area of said reinforcing member is 50% or less of the area of said bottom plate.

18. A frame according to claim 13, wherein the area of said reinforcing member is 30% or less of the area of said bottom plate.

19. A frame according to claim 13, wherein said reinforcing member is a plate-like member.

20. A frame according to claim 13, wherein the four regions separated by said first recessed portion and said second recessed portion include stepped portions formed so as to be more recessed, in the same direction as the recess directions of said first recessed portion and said second recessed portion, on a side close to the crossing region than on a side remote from the crossing region, and wherein said reinforcing member is fixed to said stepped portions.

21. A frame according to claim 20, wherein said reinforcing member is fastened to said stepped portions by caulking.

22. A frame according to claim 13, wherein said bottom plate has a rectangular shape and includes a bent portion at a peripheral edge portion of said bottom plate, said bent portion being bent in a direction in which said first recessed portion and said second recessed portion are recessed relative to a plane of said bottom plate on which said first recessed portion and said second recessed portion are formed.

23. A frame of an image forming apparatus, said frame comprising:

a bottom plate provided at a bottom of said frame and having a rectangular shape;

a first recessed portion provided on said bottom plate and extending from a neighborhood of a first corner of said bottom plate toward a central portion of said bottom plate;

a second recessed portion provided on said bottom plate so as to be recessed in the same direction as a recess direction of said first recessed portion and extending from a neighborhood of a second corner of said bottom plate toward the central portion of said bottom plate, said second recessed portion connecting with said first recessed portion in a neighborhood of the central portion;

a third recessed portion provided on said bottom plate so as to be recessed in the same direction as the recess directions of said first recessed portion and said second recessed portion and extending from a neighborhood of a third corner of said bottom plate toward the central portion of said bottom plate, said third recessed portion connecting with said first recessed portion and said second recessed portion in the neighborhood of the central portion, a fourth recessed portion provided on said bottom plate so as to be recessed in the same direction as the recess direction of said first recessed portion, said second recessed portion, and said third recessed portion and extending from a neighborhood of a fourth corner of said bottom plate toward the central portion of said bottom plate, said fourth recessed portion connecting with said first recessed portion, said second recessed portion and said third recessed portion in the neighborhood of the central portion; and a reinforcing member configured to reinforce said bottom plate, wherein said reinforcing member is fixed to a first region sandwiched between said first recessed portion and said second recessed portion, a second region sandwiched between said second recessed portion and said third recessed portion, a third region sandwiched between said third recessed portion and said fourth recessed portion, and a fourth region sandwiched between said fourth recessed portion and said first recessed portion, so as to cover a connecting region where said first recessed portion, said second recessed portion, said third recessed portion, and said fourth recessed portion connect with each other, and wherein an area of said reinforcing member is smaller than an area of said bottom plate.

24. A frame according to claim 23, further comprising a plurality of installing portions configured to install the image forming apparatus, one of the plurality of installing portions being provided in a neighborhood of each of at least three corners of said first to fourth corners of said bottom plate, and wherein the area of said reinforcing member is smaller than a region enclosed by said plurality of installing portions mounted on said bottom plate.

25. A frame according to claim 24, wherein said first recessed portion, said second recessed portion, said third recessed portion, and said fourth recessed portion are formed so as to connect at a position of a center of gravity of a triangular shape formed by said plurality of installing portions provided at the three places.

26. A frame according to claim 24, wherein each of said installing portions is provided at a position closer to an edge than the central portion of said bottom plate.

27. A frame according to claim 23, wherein the area of said reinforcing member is 50% or less of the area of said bottom plate.

28. A frame according to claim 23, wherein the area of said reinforcing member is 30% or less of the area of said bottom plate.

29. A frame according to claim 23, wherein said reinforcing member is a plate like member.

30. A frame according to claim 23, wherein the first region, the second region, the third region, and the fourth region include stepped portions formed so as to be more recessed, in the same direction as the recess directions of said first recessed portion, said second recessed portion, said third recessed portion, and said fourth recessed portion on a side close to the connecting region than on a side remote from the connecting region, and wherein said reinforcing member is fixed to said stepped portions.

31. A frame according to claim 23, wherein said reinforcing member is fastened to said stepped portions by caulking.

32. A frame according to claim 23, wherein said bottom plate includes a bent portion at a peripheral edge portion of said bottom plate, said bent portion being bent in a direction in which said first recessed portion, said second recessed portion, said third recessed portion, and said fourth recessed portion are recessed relative to a plane of said bottom plate on which said first recessed portion, said second recessed portion said third recessed portion, and said fourth recessed portion are formed.

* * * * *